United States Patent [19]

Rovin et al.

[11] 3,968,760

[45] July 13, 1976

[54] METHOD AND APPARATUS FOR THE PRODUCTION AND HANDLING OF ARTICLES, PARTICULARLY OF TUBULAR FORM

[75] Inventors: Herman Rovin, Norwalk; Rudolf Kreidel, Shelton, both of Conn.; Lawrence J. Levine, Valley Stream, N.Y.

[73] Assignee: Automatech Industries Inc., Bridgeport, Conn.

[22] Filed: Nov. 27, 1974

[21] Appl. No.: 527,695

Related U.S. Application Data

[62] Division of Ser. No. 365,098, May 30, 1973, Pat. No. 3,865,058.

[52] U.S. Cl. ..... 112/219 R; 112/262

[51] Int. Cl.[2] ..... D05B 69/36

[58] Field of Search ..... 112/219 R, 219 A, 218 R, 112/220, 67, 87, 262

[56] References Cited

UNITED STATES PATENTS

| | | | |
|---|---|---|---|
| 1,018,796 | 2/1912 | Weis | 112/219 R |
| 1,674,388 | 6/1928 | Campbell | 112/219 R |
| 1,722,277 | 7/1929 | Couch et al. | 112/219 R |
| 1,731,001 | 10/1929 | Gail | 112/219 R |
| 1,939,464 | 12/1933 | Roseman | 112/219 R |

*Primary Examiner*—H. Hampton Hunter
*Attorney, Agent, or Firm*—Mandeville and Schweitzer

[57] ABSTRACT

The application discloses a method and apparatus for the substantially automated forming and sewing of hems on pillowcases and the like. The open end of a pillowcase is applied over hem folding forms, which first fold a large hem, and then a small blind hem is formed to conceal the raw edge of the fabric. Unique arrangements, covered in my related U.S. Pat. No. 3,865,058, are provided for effecting these hem folding operations. According to the invention, the pillowcase is then partially inflated with air and advanced circumferentially, while the hem structure is sewed into the article. The disclosure includes advantageous arrangements for the detection of an unsewn seam along the formed hem, and also advantageous arrangements for sensing the completion of the sewing operation. Automatic arrangements are provided for the insertion and sewing of a label, and the removal and stacking of the completed article after sewing.

The principles of the invention are applicable to great advantage in connection with the forming of hems or the like on any tubular article. In addition, certain features of the invention have applicability in the processing of non-tubular articles.

4 Claims, 25 Drawing Figures

METHOD AND APPARATUS FOR THE PRODUCTION AND HANDLING OF ARTICLES, PARTICULARLY OF TUBULAR FORM

RELATED CASES

This application is a division of my prior U.S. application Ser. No. 365,098, filed May 30, 1973, now U.S. Pat. No. 3,865,058, dated Feb. 11, 1975. The original application Ser. No. 365,098 included several inventive features, certain ones of which are covered in the before mentioned patent and others of which are presented in this application.

BACKGROUND AND SUMMARY OF THE INVENTION

The present invention is directed to a method and means for the forming and progressive joining (as by sewing, adhering, fusing, etc.) of hems on fabric articles, particularly articles of tubular construction. The invention has particular applicability to the forming and joining of hems on pillowcases and the like, but many of its principles may be utilized to advantage in the manufacture of other articles, both tubular and in some cases non-tubular. While the specific illustrations of this application relate to the processing of pillowcases, it will be understood throughout that at least certain aspects of the invention are not limited thereto.

In the production of a typical pillowcase, for example, it is conventional to form a so-called large hem, typically of one to four inches in length at the open end of the case. The raw edge of the fabric forming this large hem is then tucked under to form a blind or "small" hem having a width on the order of ¼ inch or so. The case is stitched in the margin of the underfolded small hem, so that both the large and small hems are secured in place by a single line of stitching. In addition, it is customary for an identifying label to be inserted under the hem and secured by the hem stitching, usually in the region of the side seam of the pillowcase.

In accordance with the present invention, a facility is provided for the highly automated forming and securing of the large hem and small hem folds of a pillowcase, and for performing similar operations on other articles. The apparatus of the invention includes a pair of freely rotating drums, constituting inner forms, which are arranged to receive the open end of the pillowcase and accommodate its free movement in a circumferential direction. Adjacent and outside the drums are arcuate plates, closely embracing the rotatable drums about a portion of their peripheries but spaced slightly therefrom. The arcuate plates and the drums, constituting outer and inner forms repsectively, are arranged to be received internally of a tubular pillowcase and arranged to be urged apart under controlled pressure to apply circumferential tension to the hem forming region of the case. When the pillowcase is thus positioned, hem forming shoes of arcuate configuration are inserted axially in the arcuate spaces between the outer and inner forms to effect an outward fold of an end margin of the pillowcase, thereby forming the large hem. When the shoes are withdrawn, the pillowcase remains supported under tension on the spaced, freely rotatable drums, in a position to be advanced circumferentially to effect sewing and other operations. As one of the more specific aspects of the invention, advantageous arrangements are provided for urging the article holding drums in a separating direction, to apply circumferential tension to the article, without danger of damaging the side seam thereof. In general, the structure described in this paragraph is claimed in our parent U.S. Pat. No. 3,865,058.

In accordance with the invention, and as a significant feature of the present application, novel arrangements are provided for injecting air into the interior of the pillowcase, while it is movably supported on the rotatable drums, to partially inflate the case and facilitate its manipulation during the performance of further operations.

To effect the formation of the infolded small seam, the apparatus of the invention includes a novel small seam folder which is uniquely adapted to effect the initiation of the small seam folding action in a tubular article, such as a pillowcase. The small seam folder device is arranged for a three-stage startup action. In the first two stages, separate, sequentially arranged sections of the small seam folder are advanced, axially of the tubular article, into engagement with the raw edge area of the large hem. The first stage of the folder serves to effect approximately 90° of the required fold, while the second stage engages the prefolded edge and completes the 180° hem fold. In addition, since the small hem folder is aligned with and precedes the sewing station, the invention provides for a third stage of operation, in which the small hem folder is reciprocated in a circumferential direction to and beyond the sewing foot, and then returned. The arrangement is such that, prior to the commencement of a sewing operation, the inturned small hem fold is made to underlie the sewing foot, and the stitching will at the outset engage a properly folded margin of small hem.

To advantage, a label inserting device is synchronized with the initiating operations of the small hem folder, enabling a desired identifying label to be inserted under the sewing foot prior to the commencement of sewing operations. Desirably, then, the label is provided with a row of stitching at the outset, and also at the termination of the sewing operation, such that a limited, desired degree of stitch overlap will occur within the confines of the label.

As another feature of the invention, there is provided an advantageous sewn-seam detector facility operative, as the hem seaming operation nears completion, to sense the approach of the starting point of the stitching and cause the sewing operation to be terminated with the desired, limited degree of overlap. Usually, although not necessarily, it is desirable that the area of stitch overlap coincide with the position of the label, making it less obtrusive. The novel sewn-seam detector includes an element received under the folded hem, on the "upstream" side of the sewing foot, lying in the path of the stitching. As the starting point of the seam reaches the detector element, continued advancement of a pillowcase or other article causes the detector to be physically displaced to control termination of the sewing operation. The special arrangement of the invention enables an effectively continuous circumferential seam to be formed with a controlled minimum overlap, sufficient to derive a desired degree of interlocking of the seam ends.

The invention also includes an advantageous form of device for sensing failure of the sewing machine to properly effect the seaming operation, whether by reason of thread break or otherwise. The new arrangement takes advantage of the fact that the fabric is held under tension, extended unsupported across a predetermined span, between the spaced drums. The main portion of the fabric is forcibly deflected out of the plane which it seeks under tension, and a movable sensing element engages the sewn hem in an adjacent area. As long as the hem is attached to the body of the fabric by proper stitching, the hem will follow the deflected contours of the main portion of the fabric. However, if the sewing machine is not functioning properly, for any reason, and the hem is not being secured to the body of the fabric, the hem will return to the tension plane, while the body of the fabric will continue to be deflected. The spaced relationship between the adjacent portions of fabric is easily sensed, and an appropriate control function is derived therefrom.

At the end of the hem sewing operation, an extender element is projected into the blind or closed end of the pillowcase, automatically effecting its axial withdrawal from the supporting drums. A stacker device, located in front of the machine, is arranged to engage the leading edge of the pillowcase and withdraw it from the extender bar for folding and collection. The method and apparatus of the invention are highly versatile, and accommodate the forming of hems of various widths in connection with pillowcases and other tubular articles in particular. As will become apparent, however, certain principles of the invention are applicable to the processing of non-tubular articles.

For a better understanding of the above and other features of the invention, reference should be made to the following detailed description of a preferred embodiment of the invention, and to the accompanying drawings.

DESCRIPTION OF THE DRAWINGS

FIG. 7 additionally illustrates the manner of inserting a label prior to the commencement of a hem sewing operation.

DESCRIPTION OF A PREFERRED EMBODIMENT OF THE INVENTION

Figure 1:
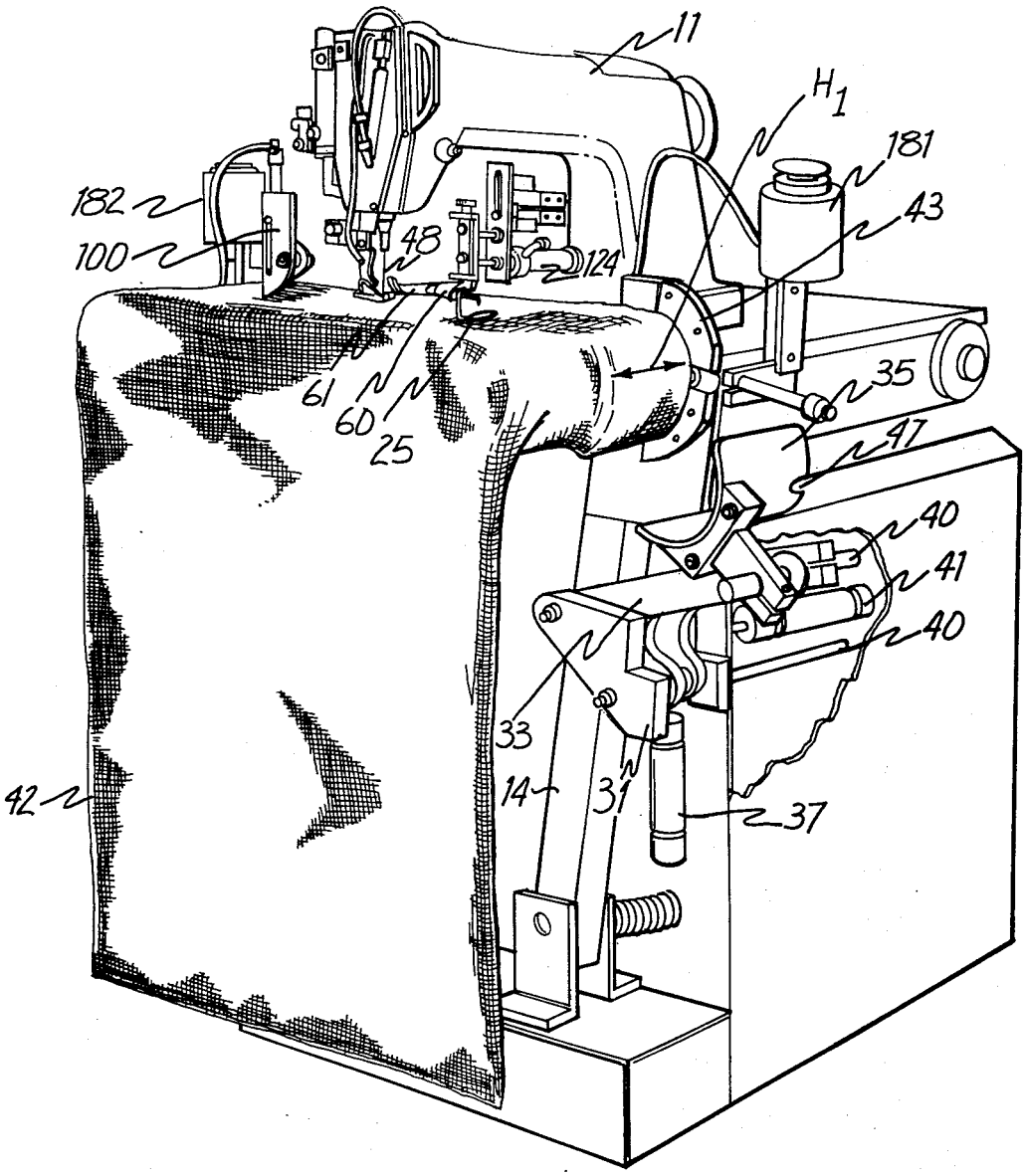
FIG. 1 is a perspective view of the hem forming and sewing machine constructed in accordance with the principles of the invention, shown with an article in position prior to the commencement of hem folding operations.

Referring now to the drawings, and initially to FIGS. 1–6 thereof, the reference numeral 10 designates generally a base or frame structure on which is mounted a sewing machine and related mechanism 11 and means for manipulating a pillowcase or similar article in the manner provided by the invention. As reflected in FIG. 3, the base 10 includes a pair of pivot supports 12, 13 to which are secured a pair of upstanding tension arms 14, 15. The tension arms are interconnected by a suitable equalizer mechanism, such that the arms are caused to pivot in symmetrical relation, either toward or away from the central axis of the machine. In the illustrated apparatus, the equalizer mechanism comprises a rotatable equalizer arm 16, pivoted about an axis 17, and connected to the respective tension arms 14, 15 by means of pivoted links 18, 19.

Interconnecting the tension arms 14, 15 is a fluid cylinder 20, which can be controllably actuated to urge the tension arms toward or away from each other. In accordance with one aspect of the invention, the fluid actuator 20 may be pivotally secured directly to one of the tension arms 15, as at 21. The other end of the actuator is connected at 22 to a balance lever 23, which is in turn pivotally connected at 24 to the opposite tension arm 14.

When the fluid actuator 20 is energized to extend, and thereby urge the tension arms in a separating direction, the full force of the actuator is not applied directly to the tension arms. Rather, the balance arm 23 is caused to pivot outwardly, gently urging the tension arms in a separating direction, because of the weight unbalance inherent in the system with the balance lever 23 pivoted outwardly. The substantial mass of the actuator 20 and its associated balance lever 23 serves to impart a firm initial urging force to the tension arms to start them quickly moving in a desired direction. At the same time, the full extent of the force exerted on the tension arms is carefully limited and controlled by the indirect operation of the actuator.

Suitable spring means (not shown) interconnect the tension arms and assist in controlling and limiting the effective separating force acting on the arms.

For effecting more positive return or closing movement of the tension arms, a stop lug 23*a* is located on the tension arm 14, inside the balance arm 23. When the actuator 20 is retracted the balance arm swings in until it engages the stop lug, after which the arms 14, 23 are effectively locked together.

Near the upper ends of the tension arms 14, 15 there are mounted a pair of hollow cylindrical drums 25, 26. These drums are journaled in cantilever fashion from the tension arms, and to advantage are arranged to be freely rotated. The drums are spaced well apart, and are of a diameter and spacing appropriate to the circumferential dimension of the tubular article to be processed, such that the article may be trained over the drums, with an ample space being provided therebetween to receive the necessary sewing machine and other mechanisms to be described. The axial length of the drums may be, and typically is substantially less than the overall length of the article being processed, but typically somewhat larger than the length of the hem being formed. By way of example only, in a machine adapted particularly to the forming of hems of one to four inches in length in pillowcases in a length range of around 30–46 inches and having a circumference of around 37–46 inches, the drums 25, 26 typically may have a diameter on the order of four inches and a length on the order of nine inches. As will be apparent hereinafter, the drums 25 and 26 constitute a set of inner hem-folding forms functional in the large hem folding operation, and they also serve to support the article during that folding operation as well as during subsequent processing of the article.

Also mounted on the tension arms 14, 15, and disposed in coaxial relation to the respective drums 25, 26, are semi-cylindrical arcuate plates 27, 28. These plates, constituting a set of outer hem-folding forms, are fixed to the tension arms 14, 15, embracing the outwardly portions of the drum surfaces in spaced relation so as to form semi-cylindrical spaces 29, 30 between the outer surfaces of the drums and the inner surfaces of the semi-cylindrical plates.

Below the cylindrical durms 25, 26, the tension arms carry brackets 31, 32 having pivoted thereto arms 33, 34. For convenience, these may be referred to as hem-folder arms. Attached to these respective arms are hem-folding shoes 35, 36, in the form of semi-cylindrical plates. These are of a size and shape to be received within the arcuate spaces 29, 30, with sufficient clearance to accommodate two thicknesses of the material forming the tubular article to be processed.

Each of the brackets 31, 32 carries a fluid actuator 37, 38, and these are connected to the respective hem-folder arms 33, 34. When the actuators 37, 38 are energized, the arms 33, 34 are pivoted inwardly to fixed stop positions determined by adjustable stops 39. When the levers have reached their stop positions, the arcuate folding shoes 35, 36 are properly aligned with the arcuate spaces 29, 30 surrounding the drums.

As reflected in FIG. 1, the brackets 31, 32 of the large hem folding mechanism are slidably mounted by guide rods 40, for linear movement in a forward-rearward direction, parallel to the axes of the article supporting drums 25, 26. Each of the brackets 31, 32 is connected to a fluid actuator 41 arranged to effect linear forward-rearward movement of the brackets and the arcuate shoes 35, 36 carried thereby. The arrangement of the respective actuators 37, 38 and 41 is such that, with the linear movement actuator 41 extended, the pivoting movement actuators 37, 38 may be energized to swing the arcuate shoes 35, 36 into position closely embracing the outer ends of the drums 25, 26, in an area beyond the end extremities of the arcuate outer forms 27, 28. This is reflected in FIG. 1. Thereafter, the linear motion actuators 41 are energized to retract, and this causes the arcuate shoes 35, 36 to move axially into the arcuate clearance space between the drums 25, 26 and the surrounding form plates 27, 28.

To carry out a hem folding operation by means of the apparatus as thus far described, a tubular article, such as the pillowcase 42 shown in FIG. 1, is manipulated (typically manually) to apply its open end over the arcuate outer form plates 27, 28, until the raw end edge of the fabric engages abutment flanges 43 carried by the tension arms. The actuator 20 is thereupon energized, caused to extend through a relatively short, fixed stroke, to swing the balance lever 23 outward and apply controlled separating force to the arms. The pillowcase 42 is thereby placed under a controlled amount of circumferential tension, with the end extremities of the case being supported by the outer form plates 27, 28, and the adjacent regions of the case being supported on the outer surfaces of the drums 25, 26, all as reflected in FIG. 1. Final positioning of the pillowcase may be accomplished after the case is placed under tension.

With the pillowcase properly positioned and under circumferential tension, the arcuate shoes 35, 36 are brought into embracing position about the outer ends of the drums 25, 26, by appropriate energizing of the actuators 37, 38. The linear motion actuators 41 may then be energized to retract, drawing the arcuate shoes 35, 36 into the arcuate spaces 29, 30.

When the shoes 35, 36 are pivoted inwardly, fabric surrounding the drums 25, 26 is engaged with sufficient friction, in relation to that exerted by the drums themselves, that the entire case is moved bodily in an axial direction for a distance equal to the full stroke of the linear movement actuators 41. In this respect, the stroke of the actuators 41 is equal to or perhaps slightly greater than the length of the largest hem to be formed in the large hem folding operation.

Figure 2:
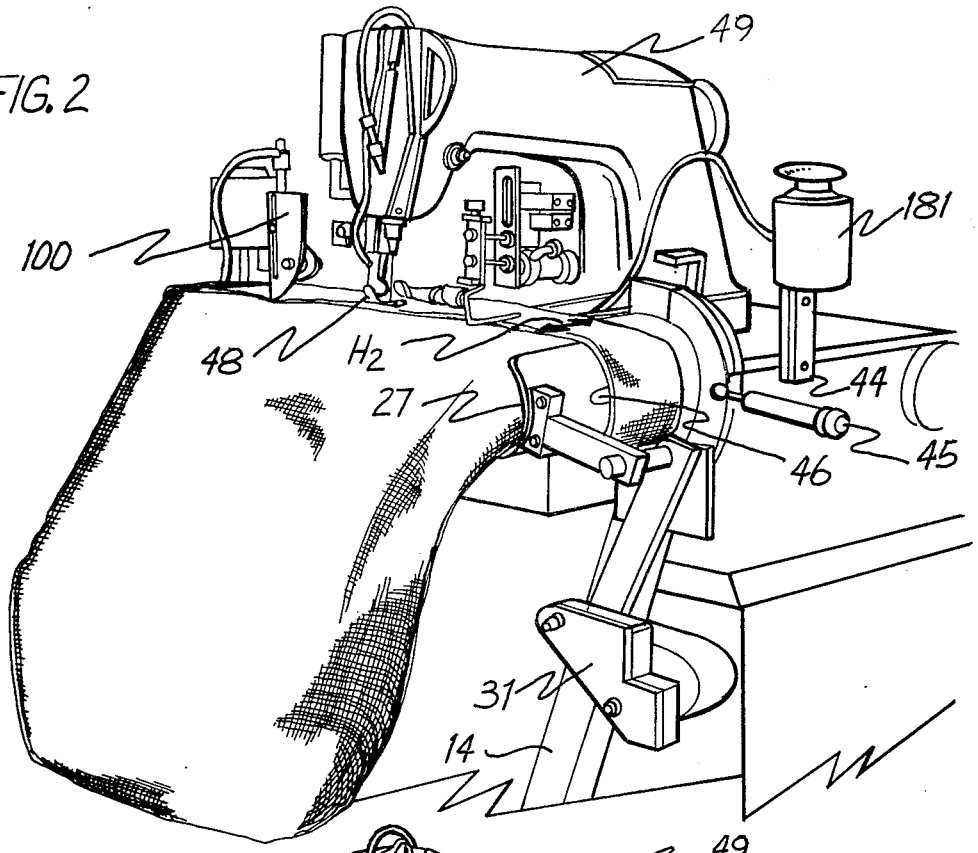
FIGS. 2 and 2*a* are sequential perspective views, similar to FIG. 1, illustrating the apparatus in the process of forming a large hem.
Figure 2A:
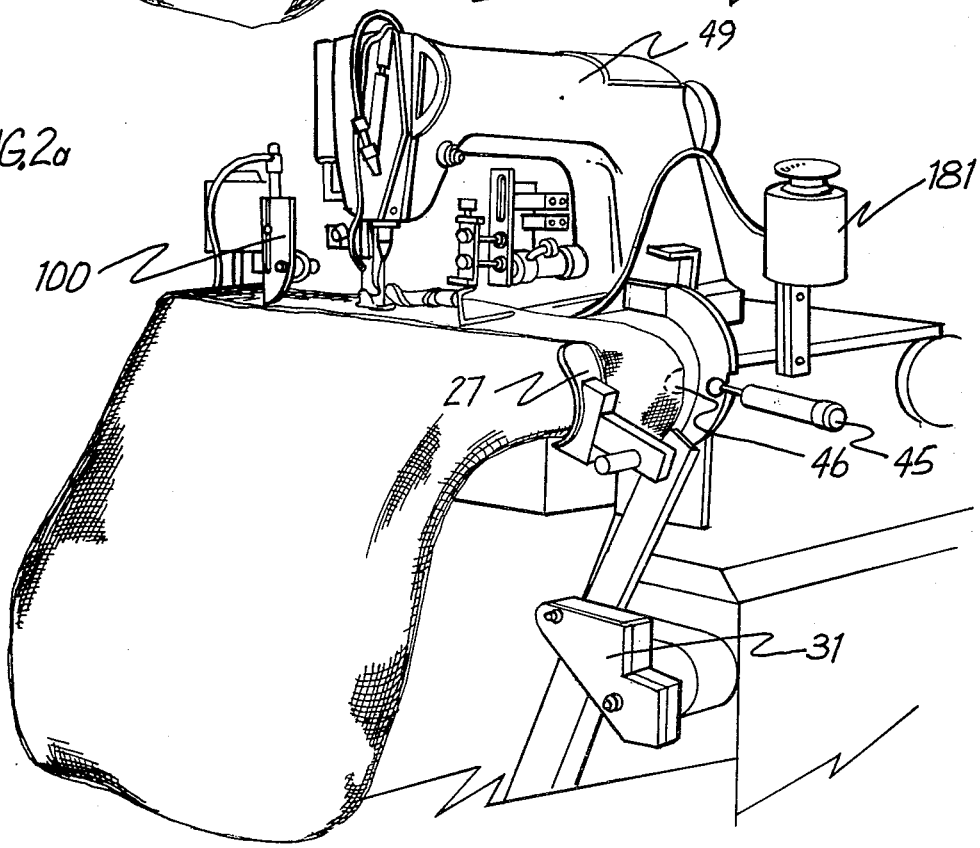
Figure 3:
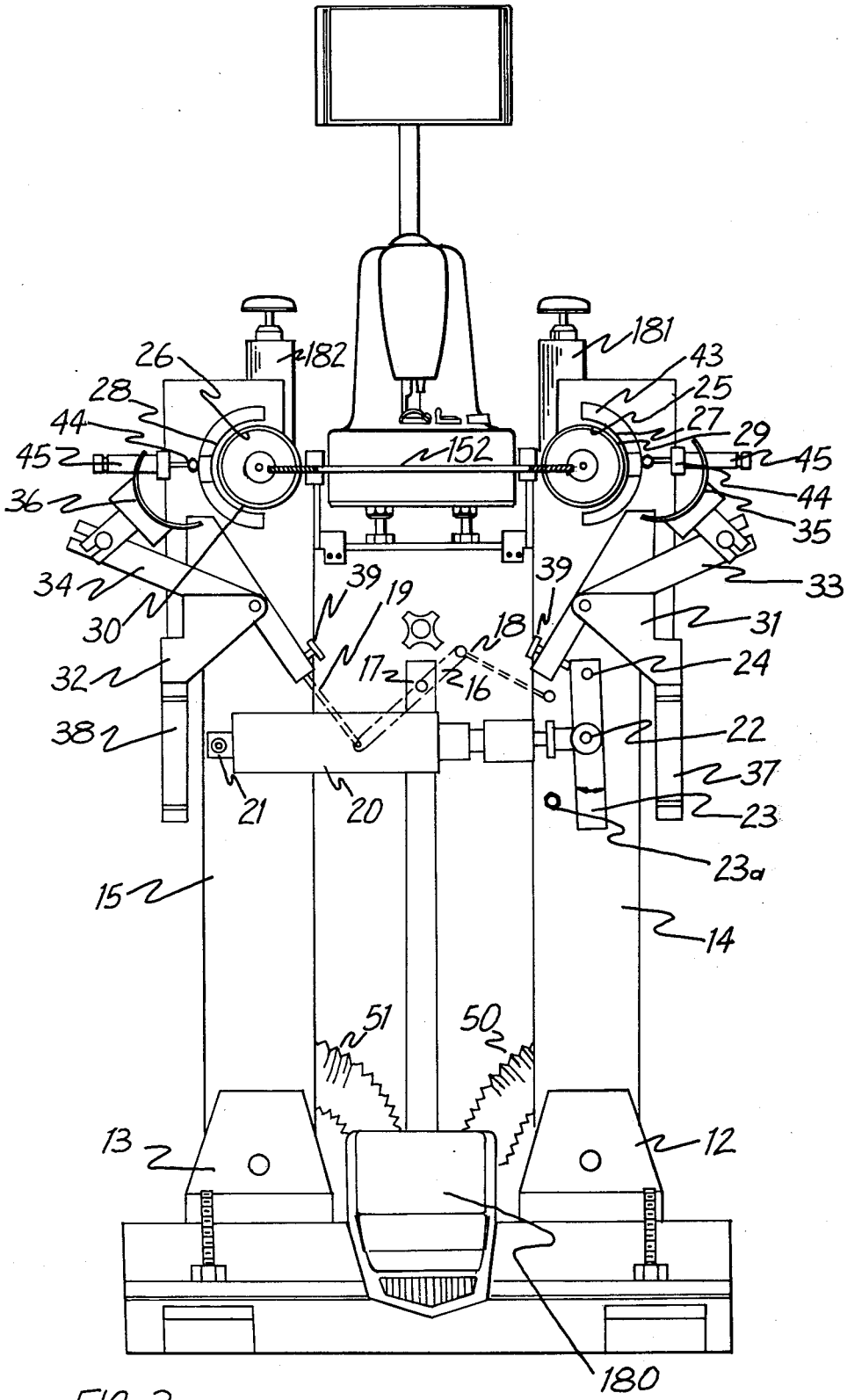
FIG. 3 is a front elevational view of the apparatus of FIG. 1.

As the shoes 35, 36 are advanced in the arcuate spaces 29, 30, carrying the fabric bodily along with them, the end extremities of the fabric, initially received over the outer form plates 27, 28 are progressively turned inside-out and drawn into the spaces 29, 30, with the end edge being progressively retracted outward along the outside surfaces of the plates, as will be understood. At the end of the full stroke of the shoes 35, 36, the entire end margin of the fabric, initially received over the plates 27, 28, will have been folded outward to constitute an out-turned large hem. The free end portions of the shoes 35, 36 will be received underneath a portion of the folded large hem. The pertinent relationships are illustrated in FIGS. 1 and 2, in which the hem-forming margin is designated by the reference character $H_1$ in FIG. 1, and the folded-over hem is designated by the reference character $H_2$ in FIG. 2, it being understood that the dimensions of $H_1$ and $H_2$ are substantially equal in practice.

To enable the hem-forming shoes to be withdrawn from their fully inserted positions, without disrupting the newly folded large hem, each of the tension arms 14, 15 is provided with a retaining finger 44 carried by a fluid actuator 45. The retaining fingers 44 are arranged to be projected by the actuators 45 radially toward the article supporting drums 25, 26, being received through openings 46 in the outer form plates 27,

28 (FIG. 2) and through arcuate slots 47 in the hem-folding shoes 35, 36 (FIG. 1). The actuators 45 are energized in appropriate sequence, after full penetration of the shoes 35, 36, and serve to press the folded hem tightly against the surfaces of the drums 25, 26 while the folding shoes 35, 36 are withdrawn linearly and pivoted to their initial, retracted positions. Desirably, the linear movement actuators 41 are retracted at this stage to move the folding shoes 35, 36 and their respective mounting arms rearward. This keeps them out of the way during the sewing operations, and they are returned to forward positions at the end of the machine cycle.

At this stage, the pillowcase 42 or other tubular article remains supported solely by the rotatable drums 25, 26, under predetermined circumferential tension sufficient to hold the article in position and enable it to be handled effectively. It will be understood, in this respect, that while the arcuate hem-folding shoes 35, 36 engage only a limited portion of the circumference of the tubular article, the action of these shoes, in conjunction with the drums and form plates, serve to effect an outward fold-over of the large hem about the entire circumference of the article. It is neither necessary nor desirable to impart a circumferential movement to the tubular article during the large hem folding operation to effect a folding of the complete hem.

To afford adjustability in the length of the large hem, provision is made for adjustably positioning the abutment flanges 43, utilizing spacer blocks of various predetermined thicknesses. The abutment flanges are cylindrically recessed to be received about the outside surfaces of the arcuate outer form plates 27, 28. The length of exposed forward portions of the plates 27, 28 corresponds to the length of the desired hem.

Figure 6:
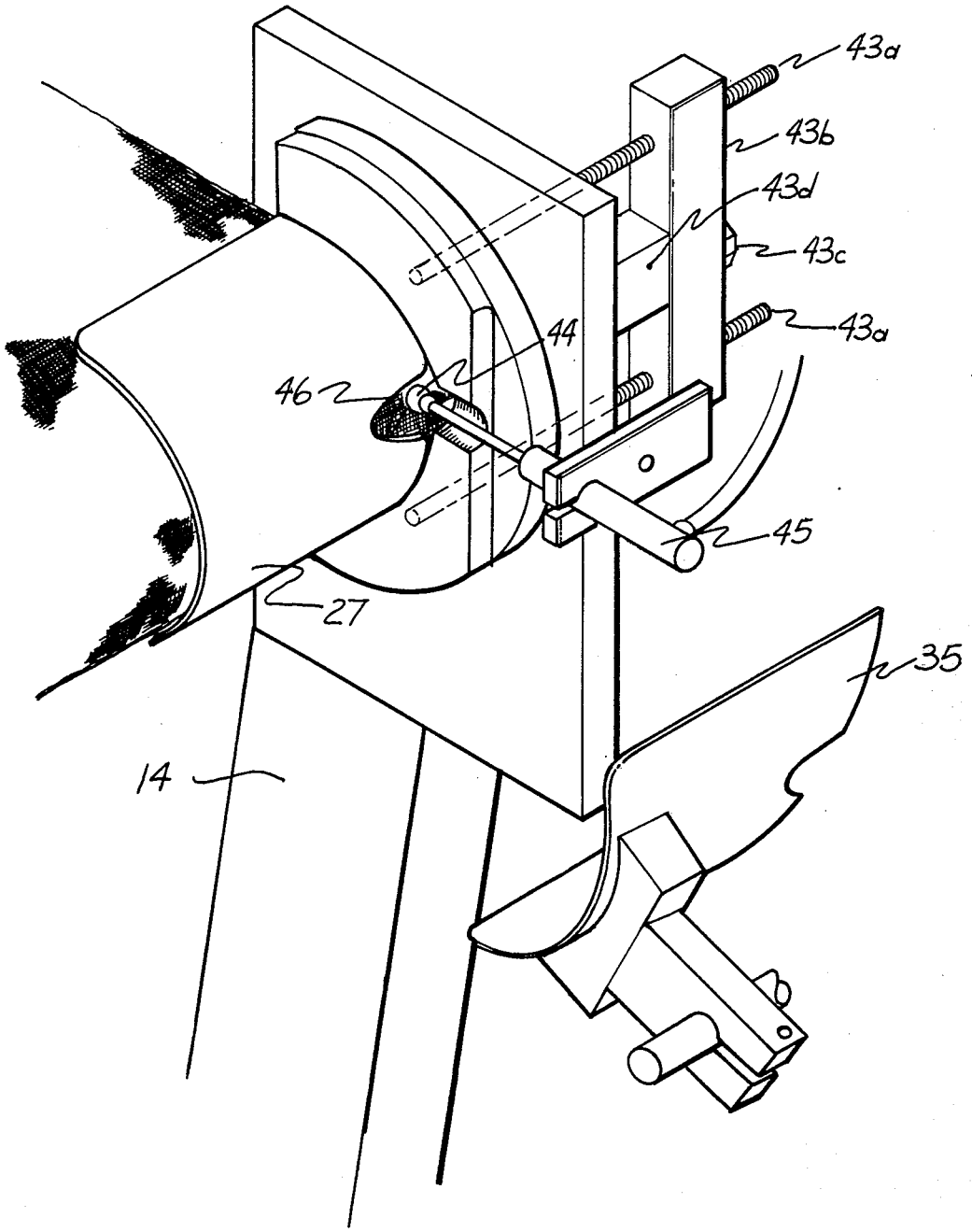
FIG. 6 is a fragmentary perspective view of the apparatus of FIG. 1, illustrating spacer means incorporated therewith for adjusting the length of the folded hem, and illustrating means providing for retaining the folded hem in position during withdrawal of the folding means.

As reflected in FIG. 6, the abutment flanges 43 are mounted on pairs of guide rods 43*a* extending slidably through and behind the respective tension arms 14, 15. The respective pairs of guide rods are connected behind the tension arms by yoke bars 43*b*, which are in turn secured to the tension arms by bolts 43*c*. Appropriately sized gage blocks 43*d* are selectively interposed between the yoke bars and the tension arms to fix the location of the abutment flanges 43 and thereby the effective length of the large hem. For a hem of maximum length, spacer blocks 43*d* of maximum thickness would be utilized, and vice versa.

Since it is contemplated that the forward-rearward stroke of the shoes 35, 36 will be held constant with varying large hem length, provision is made for adjusting the position of the sewing head and other hem-tracking elements in a manner to be hereinafter described.

As reflected in FIG. 2, when the pillowcase 42 is supported by the drums 25, 26, with the large hem having been folded, the hem region of the pillowcase extends in a more or less unsupported manner from one drum to the other, being held in a relatively flat condition, however, by reason of the circumferential tension applied by the outwardly urged drums. The upper reach of the fabric, thusly held under tension, passes through the jaws of a sewing head 48 forming part of a sewing machine unit 49. The sewing machine 49 may be a conventional commercial unit, such as a Singer 281-1 or Union Special 63400 lock stitch machine. The specific machine is not pertinent to the invention.

Indeed, the hem need not, within the invention, be sewed, but may be secured or joined in any suitable manner such as by adhesives, or by fusing, for example. In the illustrated system, the sewing head is provided with a conventional incremental feed mechanism, adapted to controllably advance the fabric past the sewing head 48 as a sewing operation proceeds. In this respect, the illustrated apparatus relies upon the feeding capability of the sewing machine itself to effect fabric manipulation during the sewing operation, the article supporting drums 25, 26 being freely rotatable to accommodate the demands of the sewing machine feed. In some cases, however, it is desirable to effect synchronous driving of the drums.

In accordance with the invention, proper manipulation of the pillowcase 42, during its circumferential advancement by the sewing machine, is facilitated by placing the interior of the pillowcase under increased air pressure. This imparts a "ballooning" effect to the pillowcase, as shown in FIG. 2, as compared to permitting the case to drape in a limp fashion downward from the ends of the drums, as reflected in FIG. 1. To this end, the tension arms 14, 15 are in the form of hollow air ducts, connecting near the lower ends with air supply tubes 50, 51. Air under pressure from a suitable blower (not shown) flows upward through the tension arms and is discharged therefrom through tubular drum supports into the hollow interiors of the cylindrical drums 25, 26. Other arrangements may, of course, be provided for injecting air into the interior of the pillowcase. However, the described arrangements are considered optimum, as they provide for a free flow of air into the pillowcase with a minimum interference with the article and the necessary manipulations of it.

The forming of the large hem fold is followed, prior to the commencement of sewing, by the formation of the so-called small hem. In the small hem folding operation, the outwardly facing raw edge of the fabric, constituting the extremity of the large hem, is turned in and under for a short distance (e.g., ¼ inch). Sewing then proceeds along the small hem, simultaneously securing both the large and small hems in a manner generally well known. With the method and apparatus of the present invention, however, a special sequence of operations is observed, in order to effect a proper commencement of the small hem fold, and to assure that the folded small hem extends underneath the sewing machine foot at the commencement of the sewing operation.

Referring now to FIGS. 7, 13, 14, 22 and 23 of the drawing, the small hem folder is shown to comprise first and second stage folding elements 60, 61 mounted by a bracket 62 carried by the sewing machine mount for limited vertical movement. While the forming of a small hem fold in successive stages is in itself known, the arrangement of the present invention is considered unique in that the first and second folding stages 60, 61 are secured to the bracket 62 by individual, independently controllable fluid actuators 63, 64 arranged to move the hem folding elements in a direction tranversely of the circumferential direction of the article, along which the small hem is progressively formed.

In the starting position, with the bracket 62 lowered into operative position, the small hem folding elements 60, 61 are initially positioned by extension of the actuators 63, 64 to lie beyond the raw end edge of the fabric after folding of the large hem. When the large hem folding operation has been completed, the actuator 63 is energized to advance the first stage folding element transversely into engagement with the raw edge of the fabric. The fabric edge is guided between an inclined tongue 65 (FIGS. 22, 23) and the upper wall 66 of the folding element, so that the raw edge 67 of the fabric enters the folding channel and is guided through a bend or fold of approximately 90°. Thereafter, in sequence, the second stage folding element is drawn toward the fabric edge by energizing of the actuator 64. The first and second stage folding elements 60, 61 are located in a closely adjacent upstream-downstream relationship, relative to the axis of the hem. Thus, as the second stage element is brought into adjacency and alignment with the first stage element, the partially folded hem is reliably carried through a second 90° of fold, so that the portion of fabric embraced by the small hem folding element has the desired 180° underfold. In their operative positions, the hem folding elements 60, 61 are appropriately aligned with the sewing needle 68, immediately upstream of the sewing machine foot 69, so that, as the sewing operation proceeds, the raw edge of the fabric is progressively folded in the first and second stages and drawn immediately through the sewing head.

To advantage, the actuators 63, 64 for the small hem folders are provided with adjustable retraction stops 63*a*, 64*a* to limit the retracting stroke. By this means, the operating portions of the small hem folders may be adjusted in relation to the sewing axis to control or adjust the gage of the small hem.

In order that the sewing operation may commence with the sewing of an already formed small hem, rather than being initiated with the sewing of a short length of unhemmed fabric, provision is made for the reciprocation of the small hem folder in the direction of the hem axis to or slightly beyond the sewing foot. Thus, prior to the lowering of the sewing foot and the commencement of the sewing operation, there is a short length of preformed small hem extending on the downstream side of the regular operating position of the small hem folder. To this end, both of the first and second stages of the small hem folder, together with the associated actuators 63, 64, are mounted on a slide bar 70 forming part of the bracket 62. The slide bar 70 is connected to a fluid actuator 71. After successive energizing of the actuators 63, 64 to bring the small hem folder stages sequentially into position, the actuator 71 is energized in a third phase of a small hem folding operation to shift the slide bar 70 and the folder stages 60, 61 laterally to the left, to a point extending underneath the upraised sewing foot 69, as reflected in FIG. 14. The actuator 71 is then energized in a return direction, and the sewing foot 69 is lowered, providing a start-up condition as reflected in FIG. 7. Thereafter, as the sewing operation commences and proceeds, the small hem is progressively formed and folded as the raw edge of the fabric is drawn through the first and second stages of the small hem folder. To assure proper commencement of the first stage of folding, during the circumferential advancement of the fabric during a sewing operation, the first folding stage 60 is provided with a guide element 72, extending in an upstream direction from the folding cavity. The guide element, in addition to initiating the folding action, serves to depress the main body of the fabric downward, away from the edge of the large hem, in the region immediately in advance of the first folding stage. This provides an adequate clearance space, permitting the initial folding movements of the fabric edge to commence well upstream of the folding stage and to progress cleanly thereinto, without becoming doubled over or otherwise defective.

In the procedure of the present invention, dealing primarily with tubular articles, the hem stitching operation proceeds until the starting point of the stitching returns to the sewing head. Typically, then, stitching is overlapped for a very short distance to lock in the ends of the stitching.

Usually, a manufacturer's identifying label is inserted under the hem and secured in place by the hem stitching. To advantage, in the processing of tubular articles, according to the invention, the manufacturer's label is initially inserted under the sewing foot, so that the sewing operation is both commenced and terminated within the confines of the label. For this purpose, the apparatus of the invention includes a label-inserting device which is actuated in timed relationship to the small hem folders and the sewing head, and serves to inject a label underneath the just-formed small hem as the sewing foot descends upon it. The end of the label is thus gripped under the folded small hem, while the inserting device is withdrawn, and the sewing operation can then proceed, stitching the label in its inserted position.

Figure 7:
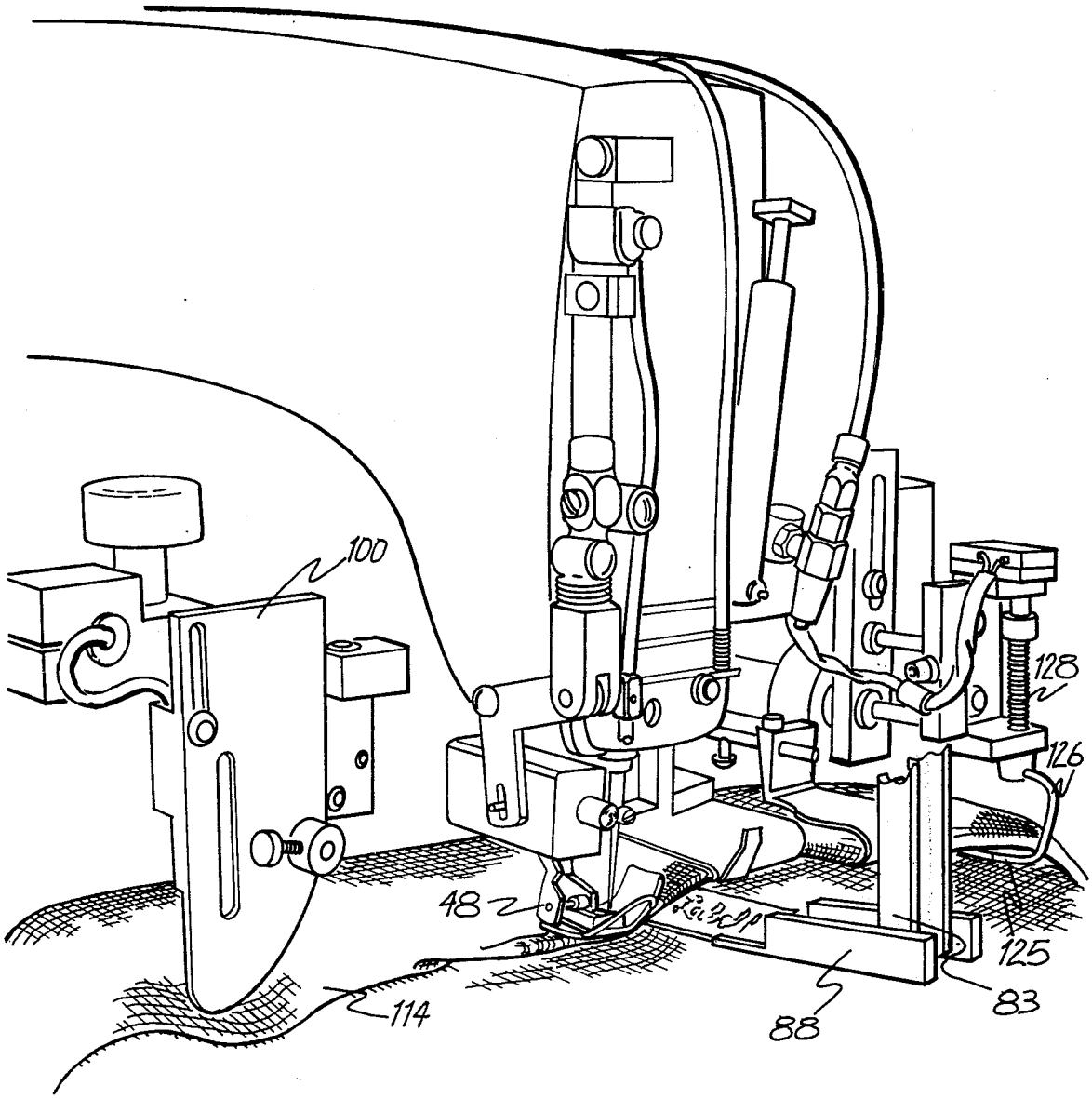
FIGS. 7 and 8 are enlarged, fragmentary perspective views of the apparatus of FIG. 1, illustrating the sewing head, small hem folding means, no-sew detector and sewn hem detector.
Figure 8:
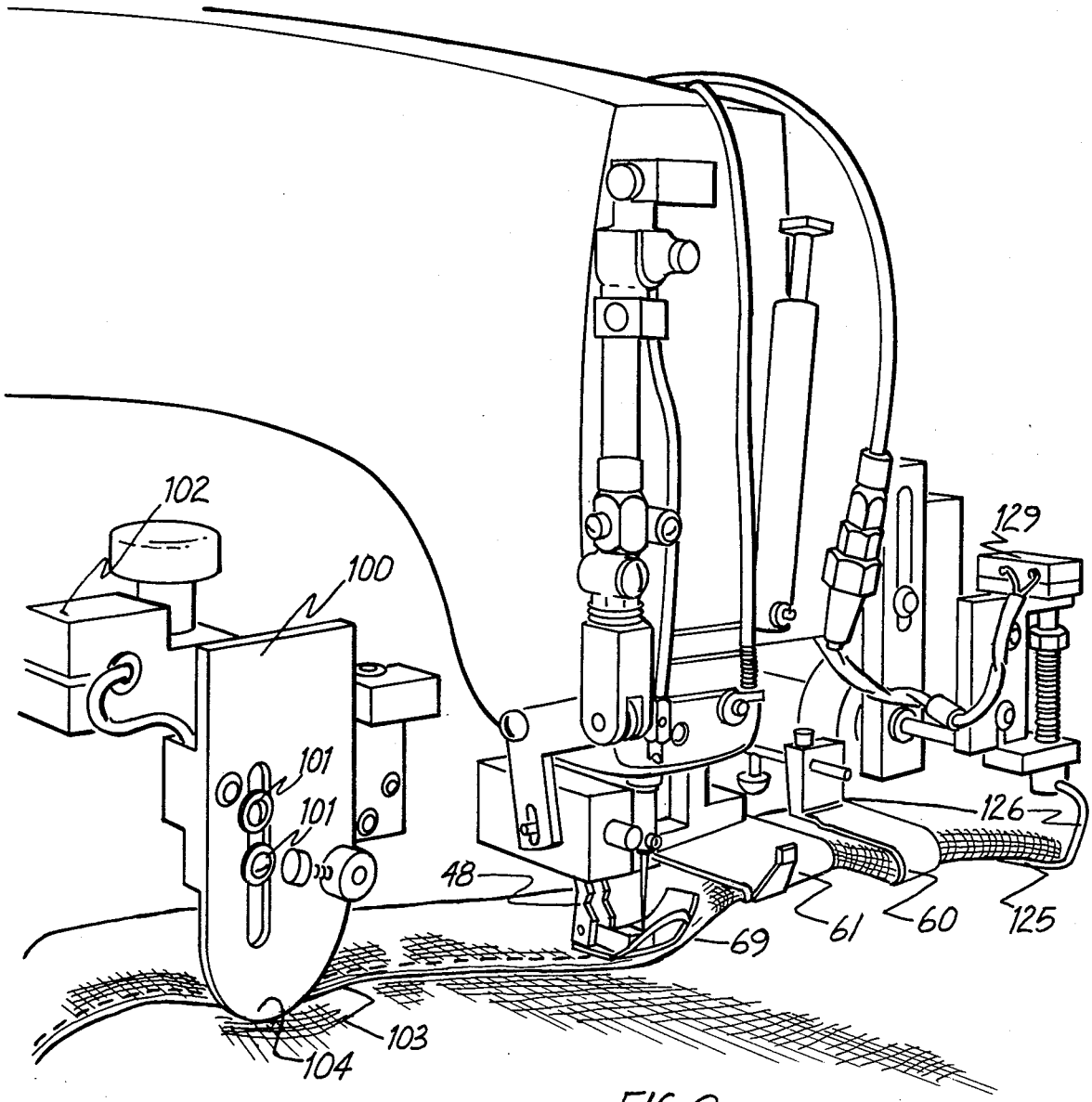
Figure 21:
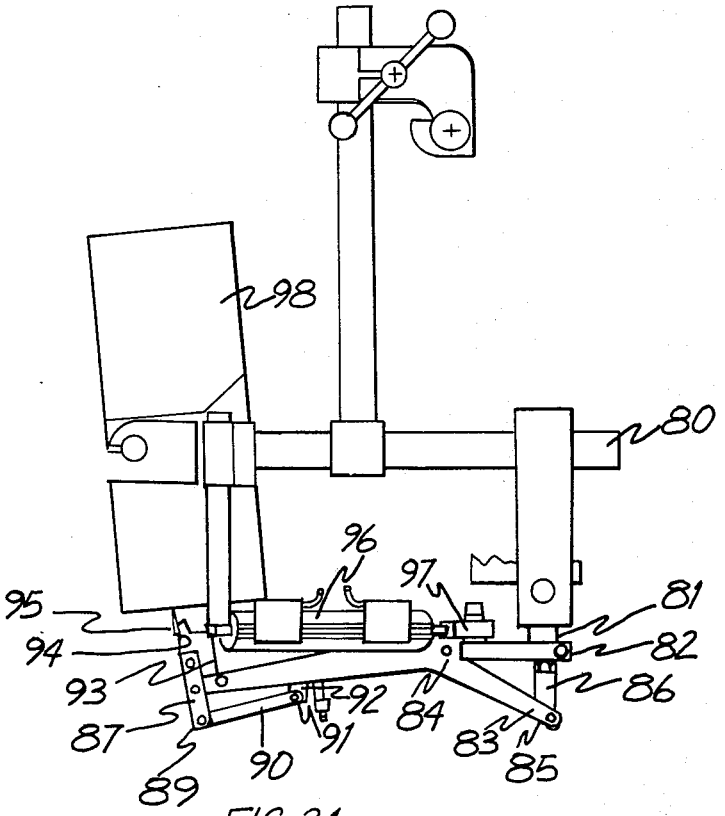
FIG. 21 is a top plan view illustrating an advantageous form of mechanism for effecting insertion of an identifying label.
Figure 22:
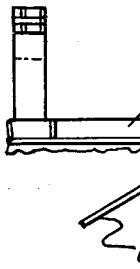
FIGS. 22 and 23 are end and front elevational views, respectively, of the first stage section of the two stage small hem folder utilized in the apparatus of FIG. 1.

Referring now more particularly to FIGS. 21 and 7, the label-inserting mechanism includes a support arm 80 carried by the sewing machine mount and journalling a member 81 for pivoting movement. The member 81 is, in this instance, the body of a fluid actuator, to the forward end of which is secured a transfer arm 82. A tucking lever 83 is pivoted at 84 to the transfer arm and is connected by a link 85 at its upper end to the movable rod 86 of the actuator.

At its lower or outer end, the tucking lever carries a foot member 87 pivotally secured by a pin 88. One end of the foot member is pivotally connected at 89 to a linking arm 90, which is in turn pivoted at 91 to an element 92 extending from the transfer arm 82. A pressor spring 93 is carried by the tucking arm 83 and has an end 94 arranged normally to contact a holding plate 95 secured to the foot member 87. A transfer actuator 96 is secured to the sewing machine mount at one end and engages the transfer arm 82 at a pivot point 97. Energizing of the actuator 96 swings the label inserter between horizontal and vertical positions.

In the horizontal position of the label inserter, the foot portion is positioned adjacent a label supply mechanism 98, which may be of a conventional, commercially available type. A folded label may then be automatically inserted in the holding plate and retained therein by the spring 93. The transfer actuator 96 is subsequently energized to bring the transfer arm 82 into an upright position, substantially as reflected in FIG. 7. The actuator 81 is then energized to extend, pivoting the tuck arm 83 clockwise. The alignment of the label-inserter mechanism is such that, when the actuator 81 is extended at this stage, the spring holding plate 95 inserts the leading edge of the label underneath a previously formed small hem, in the region directly underneath the sewing foot. In properly timed sequence, the sewing foot then descends to apply clamping force to the label. At the same time the lever action of the inserter mechanism causes the spring 93 to release the label. Thereafter, the actuator 81 may be retracted to withdraw the spring jaws, leaving the label properly positioned, with a portion projecting out from under the small hem. The label inserter may then be returned to its horizontal position by the transfer actuator 96. It will be understood, of course, that the label inserting sequence typically will immediately follow the moving into operative position of the small hem folder stages and the reciprocation thereof in a circumferential direction to initiate the small hem fold.

Figure 9:
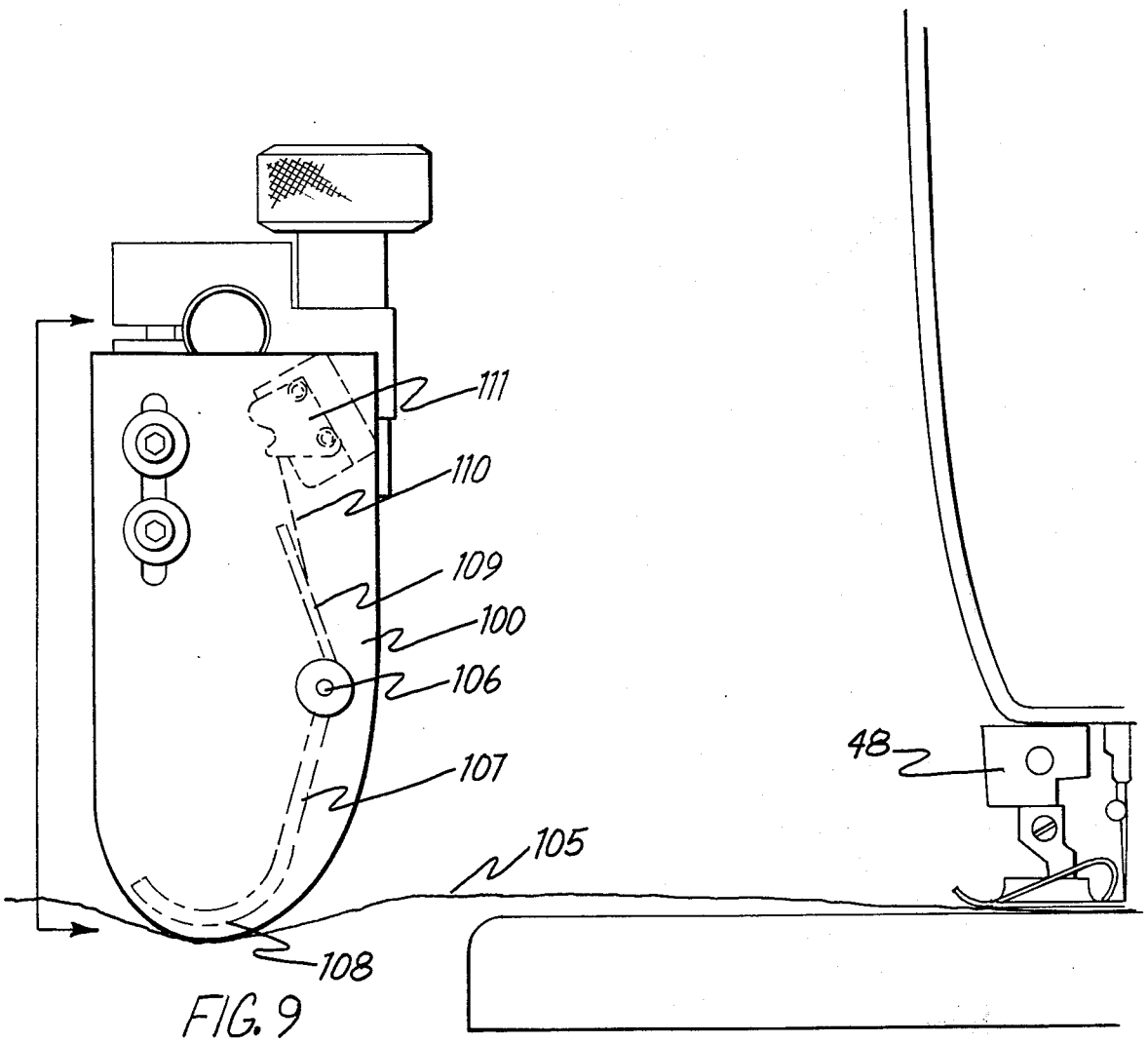
FIG. 9 is a framentary elevational view illustrating details of the no-sew detector.

In accordance with another feature of the invention, a novel and highly effective arrangement is provided for detecting a properly (or improperly) joined hem seam, downstream from the sewing head 48. The sewn seam detector, shown particularly in FIGS. 7–12, comprises a deflecting blade 100, which is adjustably mounted by bolts 101 to a bracket 102 carried by the sewing machine mount. The blade 100 is adjustably positioned in a forward-rearward direction to lie just outside of the folded over edge extremity 103 of the small hem, and the blade is adjusted vertically to a position in which its lower edge 104 lies below the tension plane 105 of the fabric (FIG. 9). The tension plane extends between the upper portions of the article supporting drums 25, 26 and the fabric of the tubular articles substantially assumes that plane when it is held under circumferential tension. The arrangement is such that, as the fabric passes progressively by the detector blade 100, the body portion 105 of the fabric, which lies outside of the folded hem, is deflected downward, below the tension plane.

Pivotally mounted behind the blade 100, by means of a pivot pin 106 is a sensing lever 107 having a curved lower foot portion 108, which is normally substantially coincident with the lower edge 104 of the detector blade. The upper portion 109 of the sensing lever is positioned to engage the actuator 110 of a control switch 111, which is mounted on the blade. The arrangement is such that, when the foot of the sensing lever 107 is permitted to coincide substantially with the bottom edge of the blade 100, the switch 111 is in one condition, indicating a properly sewn seam. If the foot of the lever is raised, causing the lever to pivot in a clockwise direction as viewed in FIG. 9, the switch 111 is actuated to a different condition, reflecting an improperly sewn seam.

Figure 10:
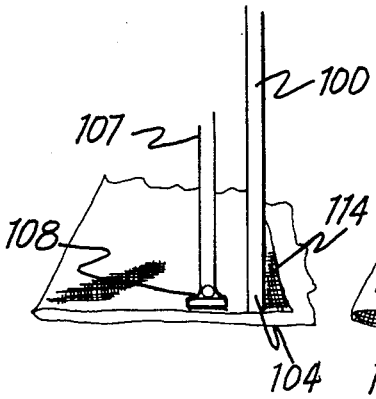
FIGS. 10–12, inclusive, are simplified, schematic views, illustrating the functioning of the no-sew detector.
Figure 11:
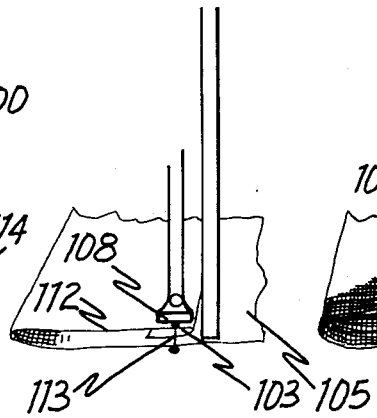
Figure 12:
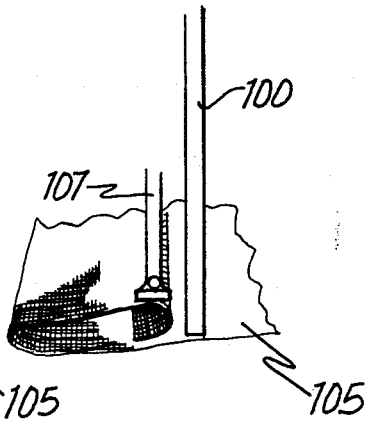
Figure 13:
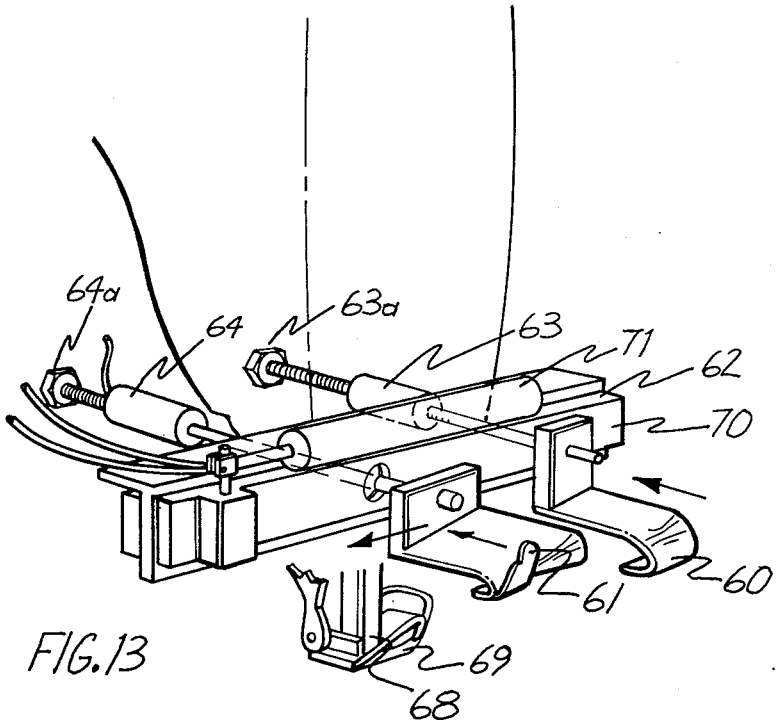
FIGS. 13 and 14 are enlarged, fragmentary perspective views of the apparatus of the invention, illustrating details of the arrangement and operation of the small hem folder mechanism incorporated in the new apparatus.
Figure 14:
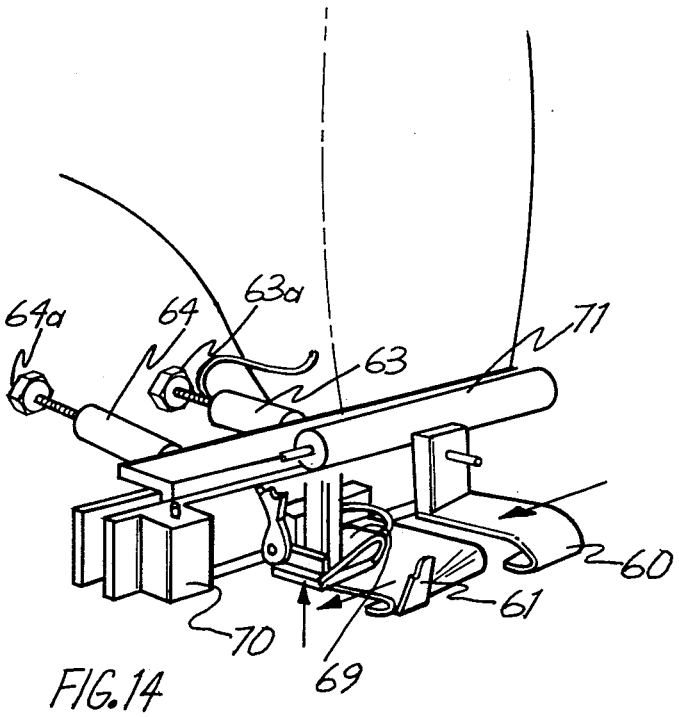
Figure 15:
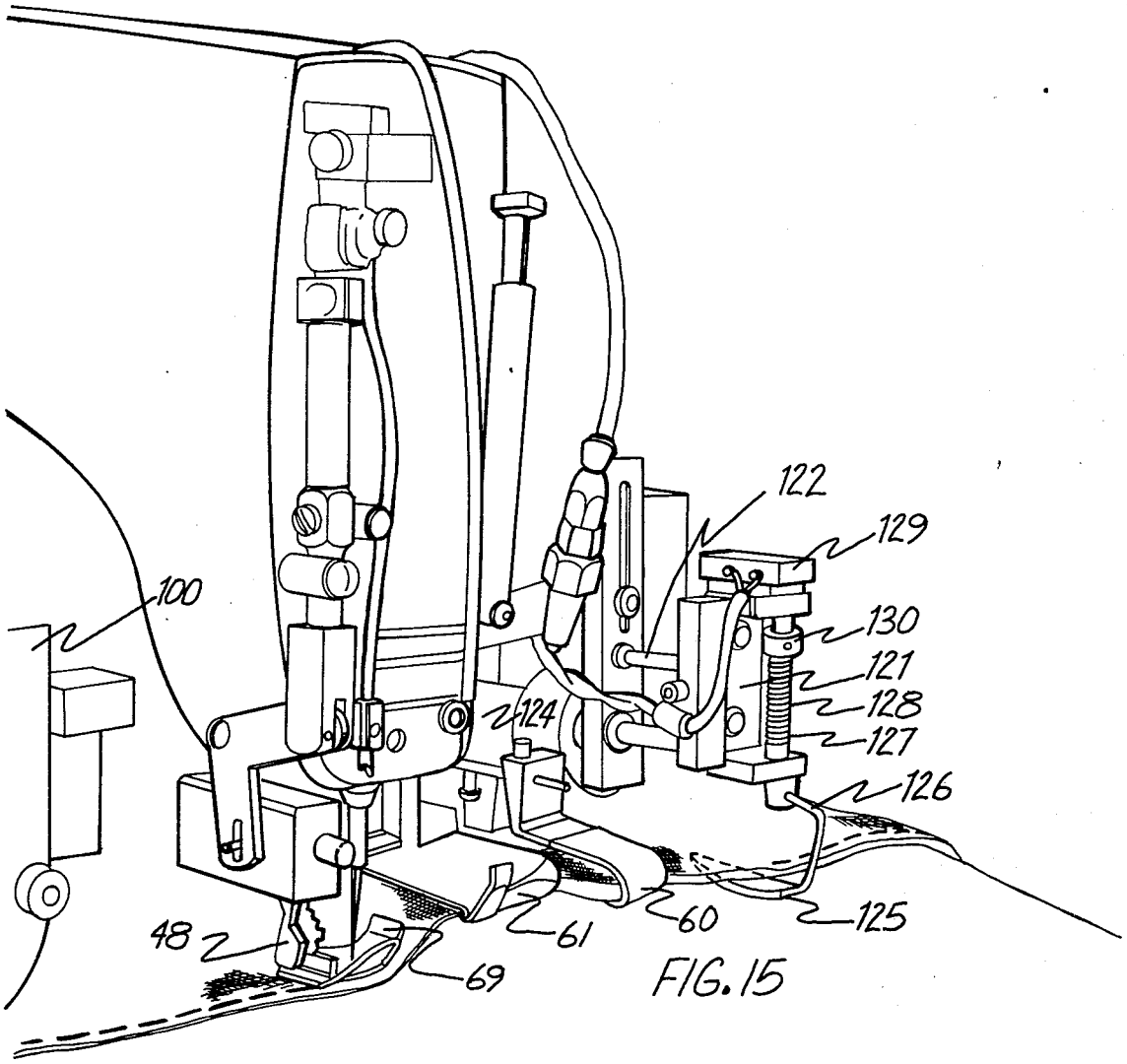
FIGS. 15–18 are sequential views reflecting the manner of operation of the sewn seam detector.
Figure 16:
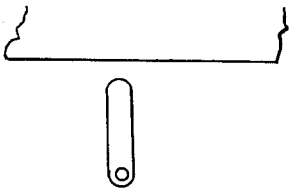
Figure 17:
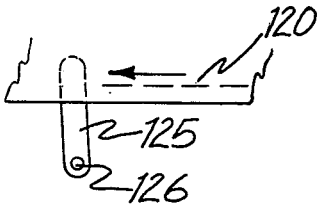
Figure 18:
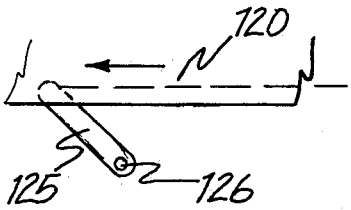

As particularly shown in FIGS. 10–12, the foot portion 108 of the sensing lever is arranged to lie immediately adjacent and on the backside of the blade 100. When the sensor is properly positioned over the fabric, the blade 100 will thus contact the body portion 105 of the fabric, while the sensing foot 108 will ride along the hem 112, most advantageously directly above the region of the under-folded small hem 113. As long as the sewing operation is being carried out properly, and the hem is secured tightly to the body fabric 105, the deflection of the body fabric by the blade end 104 will cause a similar downward deflection of the hem portion itself. However, if a broken thread or other malfunction causes a defect in the seam, such that the hem is no longer secured to the body fabric 105, the hem portion will tend to spring upward toward the tension plane, as reflected in FIG. 12. This action lifts up the sensing foot 108 and causes the control switch 111 to be actuated to stop the equipment.

At the commencement of the sewing operation, there obviously can be no sewn seam under the sensing foot 108. Nevertheless, as reflected in FIGS. 7, 10 and 11, by locating the sensor blade 100 to lie on an axis immediately outside of the folded small hem edge 103 during normal sewing, the unfolded raw edge 114 of the large hem will be caused to underlie the blade tip 104 at the commencement of sewing. This causes the hem portion 112 of the fabric to be depressed out of the tension plane just as if a properly sewn hem were passing under the detector. As the sewing operation is commenced, the sewn hem progresses downstream from the sewing head 48 toward the detector blade 100, and the raw edge 114 is gradually withdrawn from underneath the blade as the commencement of the sewn seam approaches. Assuming that the sewing operation has commenced properly, the sewn seam will arrive at the sensor as the raw edge is withdrawn therefrom, so that the sensor is not prematurely actuated.

As will be understood the sewn seam detector functions indirectly as a broken thread detector, because a break in either the main thread or the bobbin thread will reflect itself in an unsewn seam.

In accordance with another aspect of the invention, the equipment includes a novel and advantageous form of sewn seam detector, which automatically senses the return toward the sewing head 48 of the starting point 120 of the sewn seam. The arrangements for this purpose are shown particularly in FIGS. 15–18. The illustrated sewn seam detector includes a mounting bracket 121, which is supported by a guide rod 122 and by the rod 123 of a fluid actuator 124. The actuator 124 can be energized to move the bracket 121 in the forward-rearward directions to position the bracket and sewn seam detector in operative or inoperative positions.

In the illustrated arrangement of sewn seam detector, a detecting finger 125, extending in the rearward direction, is supported by a wire offset 126 from the lower end of a shaft 127. A spring 128 urges the shaft 127 to rotate to a stop position, in which the sensing finger 125 is directed toward the rear of the machine. However, the spring yieldably accommodates counterclockwise rotation of the shaft (as viewed from the top). A control switch 129 is mounted on top of the bracket 121 and is actuated by a cam 130 carried by the shaft. In the sensing position of the shaft and finger, shown in FIGS. 15, 17, the switch 29 is in one control condition, reflecting the absence of a sewn seam. However, as the sewn seam advances circumferentially toward and comes into engagement with the sensing finger 125, the finger is pushed aside by the advancing seam (FIG. 18), rotating the shaft 127 and actuating the switch 129 to a second control condition, reflecting the return of the seam. By suitable timing means, not specifically shown but of a conventional and well known type, the sewing operation is permitted to continue for a desired interval following actuation of the switch 129, sufficient to bring the ends of the seam together and, desirably, to cause a slight overlap of the seam ends.

Figure 19:
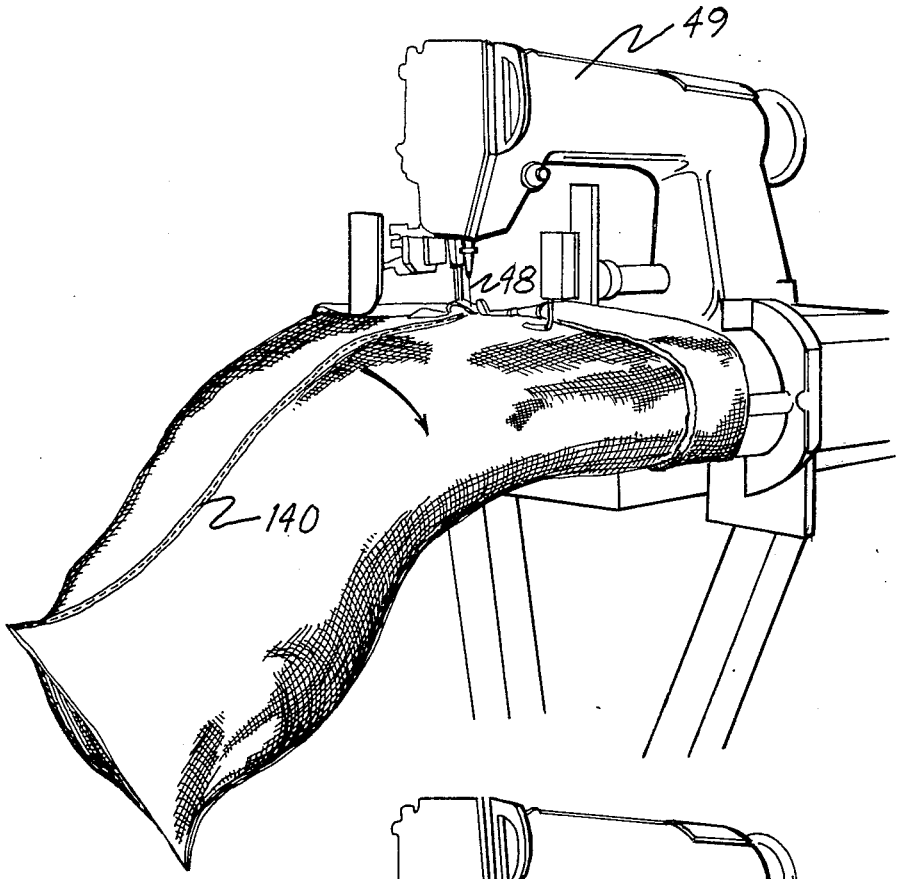
FIGS. 19–20 are sequential views illustrating the manipulation of a pillowcase at the end of a seaming operation.
Figure 20:
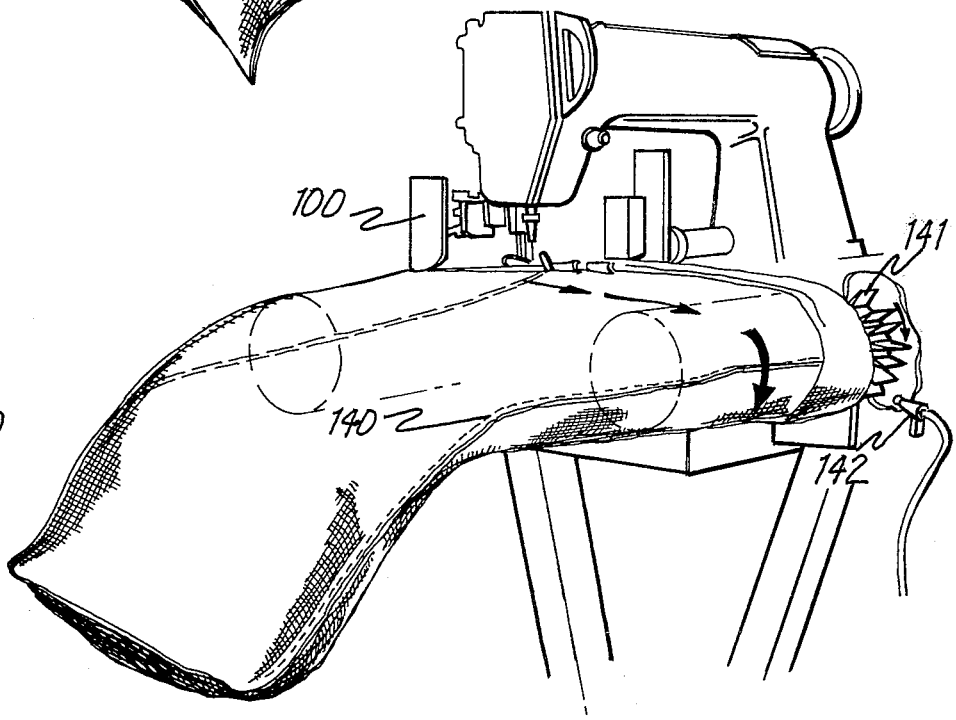

In the sewing of a pillowcase, the label preferably is positioned to coincide with the overlapped area of the stitching, and all this is located immediately adjacent the side seam 140 of the pillowcase (see FIG. 19) so as to be relatively unobtrusive. Thus, the commencement and completion of the sewing operation desirably occur with the side seam 140 of the pillowcase under the sewing head 48. For removal and stacking, however, it is advantageous to have the side seam located at the side edge of the pillowcase, as reflected in FIG. 20. To this end, provision is advantageously made for rotating one or both of the supporting drums 25, 26 after completion of the sewing operation and severing of the threads, to relocate the side seam 140. To advantage, the means for rotation may include a turbine-like arrangement of blades 141 associated with one of the supporting drums and arranged to be acted upon by an air nozzle 142. When the sewing operation has been completed, the air nozzle 142 is energized momentarily to reverse the rotation of the drums for a sufficient period of time to properly relocate the side edge 140 as shown in FIG. 20.

Figure 4:
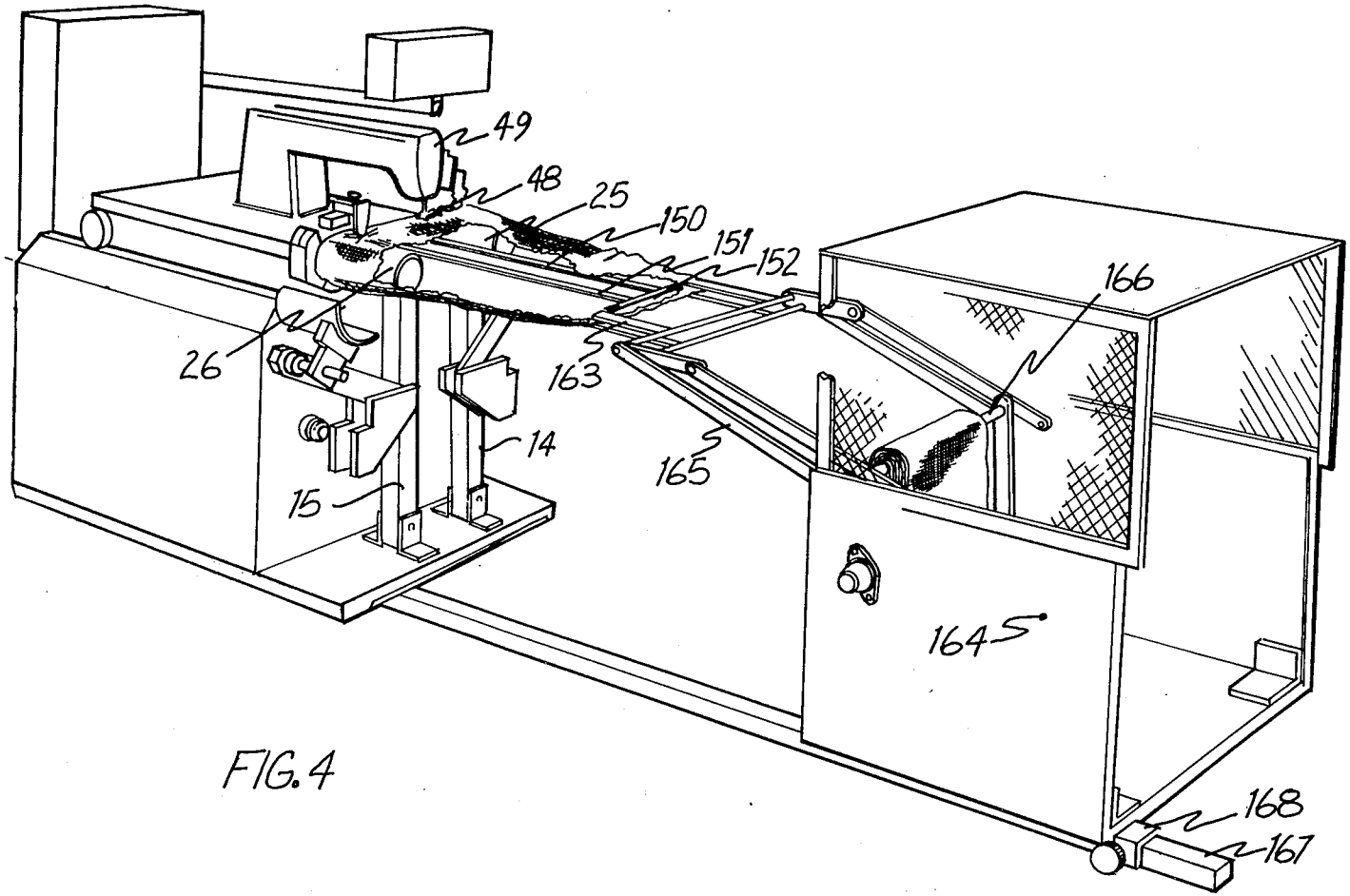
FIG. 4 is a perspective view of the apparatus of the invention, shown in conjunction with a folder-stacker apparatus arranged to receive completed articles as they are discharged from the apparatus.

The apparatus of the invention includes an extender bar 150, shown in FIG. 4, having a pair of elongated rods 151 supporting at their forward ends a transversely disposed bar 152. In its retracted position, the extender bar assembly 150 is positioned so that the cross bar 152 lies directly in front of the drums 25, 26, extending therebetween. When the sewing operation has been completed, and the side seam 140 properly relocated, the pillowcase can be ejected from the sewing machine by activating the extender bar assembly to project the cross bar 152 in a forward direction. The projected length of the extender bar 150 is controlled by a fluid actuator 153 driving a chain 154 to rotate sheaves 155 and advance extender cables 156. The extender bar assembly 150 is secured to the extender cables 156, and the projected length of the extender bar is adjusted to accommodate different sizes of articles by controlling the stroke length of the actuator 153 with appropriately located control switches (not specifically illustrated). When the extender is actuated, the cross bar 152 engages the blind end or bottom of the pillowcase and carries it outward to withdraw the pillowcase from the supporting drums.

As reflected in FIG. 4, when the extender bar 150 has been fully projected, it comes into range of the gripping jaws 163 of a folder stacker assembly generally designated by the numeral 164. The folder stacker has a parallelogram linkage 165 which, when operated by a fluid actuator (not shown) tilts the gripping jaws 163 toward the extender bar, meeting the cross bar 152 as it reaches the full extent of its projection. The jaws 163 are then actuated to close lightly and to engage the end of the pillowcase. Both the extender bar and the folder stacker can then be actuated in a retracting direction. The completed pillowcase is then released by the folder stacker and draped over a stacking bar 166. The details of the folder stacker do not form a significant part of the present invention. Desirably, however, the entire folder stacker unit 164 can be adjustably positioned in a forward-rearward direction along tracks or rails 167, to accommodate the processing of articles of various lengths. A suitable clamping device 168 may be provided to secure the folder stacker in its adjusted position.

To prevent possible snagging and tearing of the completed pillowcase as it is withdrawn from the extender bar, the end extremities 157 of the cross bar 152 are formed of coil springs secured at their inner ends to the main portion of the cross bar. The spring sections readily give way if resistance is met during removal of the pillowcase therefrom.

Figure 5A:
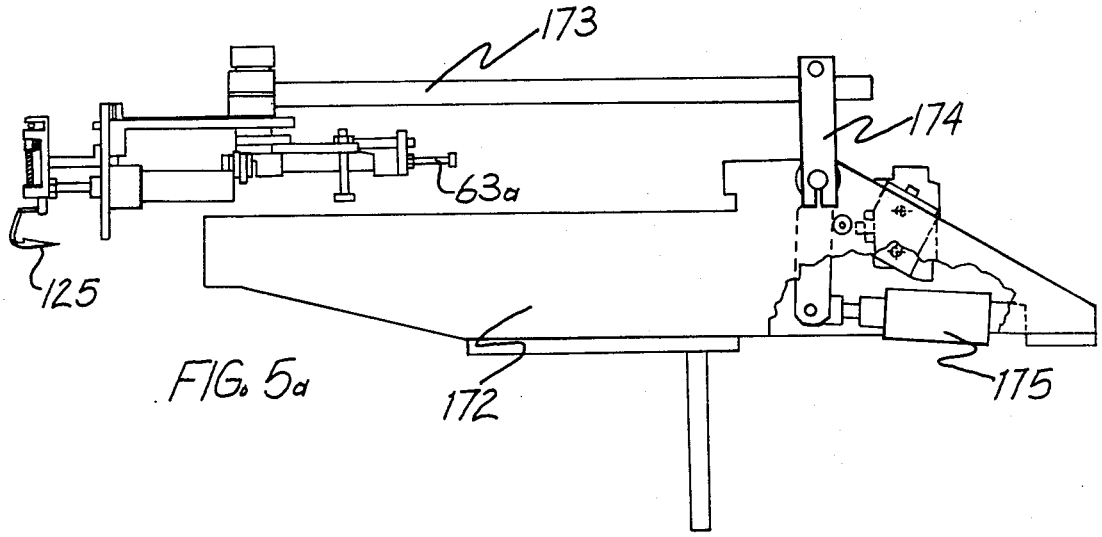
FIG. 5*a* is an enlarged side elevational view of the sewing machine mounting means of FIG. 5, illustrating supporting means carried thereby for the small hem folder and related mechanisms.
Figure 5:
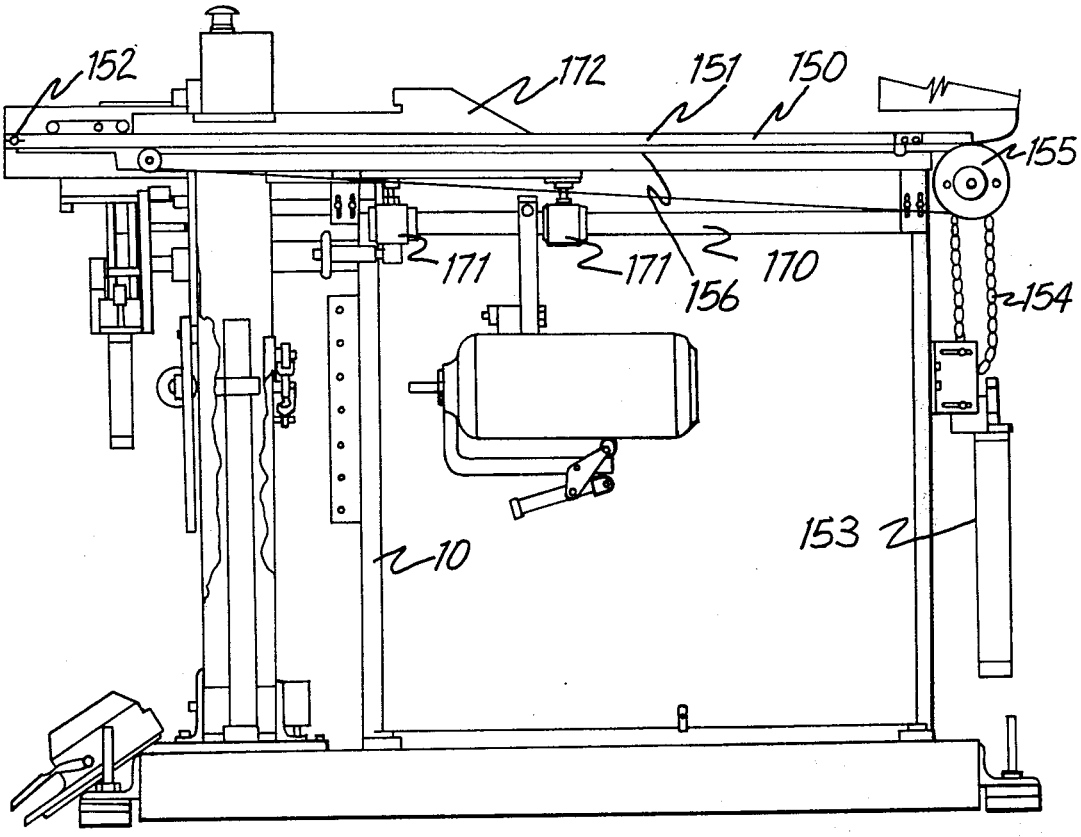
FIG. 5 is a side elevational view of the apparatus, with parts broken away to illustrate details of the sewing machine mounting arrangements.
Figure 23:
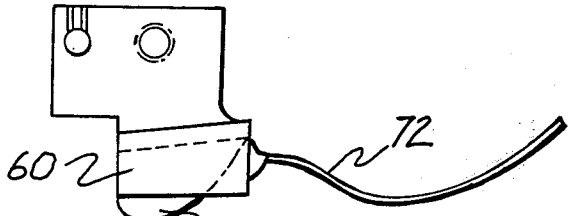

As heretofore mentioned, to accommodate adjustment of the machine to process articles with various hem lengths, it is appropriate after each change of the hem spacer blocks **43*d*, to reset the position of the sewing machine head and the various hem tracking elements to be in proper alignment with the location of the adjusted hem edge. The various hem tracking elements concerned are the small hem folder, the label inserter, the no-sew detector, and the sewn seam detector. Since each of the seam tracking elements is desirably maintained in appropriate alignment with the sewing head itself, it is advantageous to mount all of them in normally fixed relation to the sewing machine itself. To this end, as illustrated in FIG. 5*a*, the machine frame 10 is provided with a plurality of longitudinally extending guide rails 170 which slidably receive bearings 171 mounting a sewing machine oil pan 172. The sewing machine itself, not shown in FIG. 23, is appropriately secured to the oil pan 172 and can be adjustably positioned in the forward-rearward direction by sliding the oil pan along the guide rods 170. A cantilever frame 173 is secured to the oil pan by a pivot arm 174, which is in turn connected to a fluid actuator 175. In the illustrated apparatus, all of the hem tracking elements are carried by the cantilever frame 173. Each of the elements has its own individual adjustment relative to the frame, for initial alignment purposes. Thereafter, the various hem tracking elements may be retained in a fixed relation with the sewing machine head, with all the units being adjusted simultaneously by repositioning the oil pan 172 on the guide rods 170.**

The fluid actuator 175, when energized to extend, pivots the cantilever frame 173 upward to raise the various hem tracking elements above their normal operating positions. Thus, the actuator will be energized to extend at the end of a sewing operation, permitting a completed article to be removed and a new article to be applied to the machine. The cantilever frame 173 is then lowered to bring the hem tracking elements into their normal operating positions.

Summary of Operation

In the starting condition of the apparatus of the invention, the tension arms 14, 15 are in their closed or upright positions, the hem folding shoes 35, 36 are retracted laterally and projected to their forward positions, the frame 173 and the various hem tracking elements carried thereby are in an upraised position, and the sewing foot is also in a raised position. At this stage, an operator, positioned directly in front of the machine between the sewing head and the folder stacker unit, grasps the open end of a pillowcase or other tubular article and applies it axially over the supporting drums 25, 26 and the embracing form plates 27, 28. The raw edge of the article is placed in engagement with the abutment flanges 43. By stepping on a conveniently located foot switch 180 (FIG. 3), the actuator 20 is energized to swing the tension arms outwardly. This causes circumferential tension to be applied to the end margin area of the pillowcase.

At this point, the operator may commence the large hem folding operation, and this is accomplished for safety purposes by requiring the operator to place both hands upon and to depress plunger switches 181, 182 mounted atop the respective tension arms 14, 15. This initiates operation of the hem folding shoes, causing the actuators 37, 38 to be energized to swing the shoes inward against the supporting drums and, in sequence, to energize the actuators 40 to pull the shoes in a rearward direction into the arcuate spaces between the drums and the outer forms 27, 28.

At the end of the full rearward stroke of the hem folding shoes, switches are actuated to energize actuators 45, projecting the retaining fingers 44 into engagement with the article. In sequence, the actuators 40 and 37, 38 are energized to first axially withdraw the folding shoes 35, 36 and then retract them laterally and then axially to out-of-the-way positions.

With the large hem having thus been folded, the cantilevered frame 173 is automatically lowered by appropriate sequencing switches, to bring the several hem-tracking elements into operative elevation. At this stage, the label inserter is in its upraised or horizontal position, and the small hem folder stages and the sewn seam detector are all projected by their respective actuating cylinders to forward positions. The no-sew detector is, at this stage, in its normal operating position.

After initial lowering of the hem tracking elements, the actuator 124 may be retracted to bring the sewn seam detector into normal operating position, sliding the sensing finger 125 underneath the edge of the folded large hem. In addition, the small seam folder is actuated in the three-stage sequence previously described to commence formation of the small seam underfold and to extend it downstream underneath the still uplifted sewing foot 69.

Upon initiation of the small seam fold, the label inserter mechanism is actuated, first to bring down the transfer arm 82 and then to pivot the tucking arm 83 to project a portion of label underneath the small hem in the region of the sewing foot. By appropriate sequencing controls, the sewing foot is then lowered and the sewing operation commences, desirably in the region of the upstream edge of the label. The label inserter is then automatically retracted as the sewing operation proceeds, engaging and being loaded with a subsequent label for the next operation. Immediately prior to commencement of the sewing operation, the blowers are activated, causing air under pressure to be directed into the open end of the pillowcase. The pillowcase is thus caused to "balloon" and assume a shape which is relatively more symmetrical about its longitudinal axis. While thus maintained in a "ballooned" condition, the pillowcase is more readily manipulated in a circumferential direction, enabling the same sewing operations to be carried out with optimum effectiveness. As the sewing operation proceeds, the advancing mechanism of the sewing machine draws the hem of the tubular article progressively through the sewing foot in a well known manner. At completion of the operation, the sewn seam sensing finger 25 is tripped, timing the end of the sewing operation to provide the slight overlap of the stitching. Thereupon, the sewing foot 69 is raised, as is the cantilever frame 173 carrying the several hem tracking elements. Actuation of the sewn seam detector also serves to energize the actuator 63, 64, immediately projecting forward the small seam folders, so that these elements are out of the way by the time the sewn seam approaches. In addition, the actuator 124 for the sewn seam detector itself may be energized to project forward that element, as its function for the cycle has been completed.

When the sewing head and related elements have been raised, the thread connections to the machine are snipped, typically by conventional automatic means, and the extender bar is brought into operation by energizing of the actuator 153. At this time, the actuator 20 can be de-energized to return the tension arms 14, 15 to their upright positions and permit the easy removal of the completed article by the extender bar. As soon as the folder stacker mechanism has engaged and removed the completed article, an appropriate sequence switch is tripped to retract the extender bar, readying the machine for a further cycle of operations.

The method and apparatus of the present invention are uniquely advantageous in connection with the sewing of hems and seams on tubular articles. In connection with the manufacture of pillowcases, for example, an operator need simply apply the open end of the pillowcase bag, with previously formed side and bottom seam, over the article supporting drums 25, 26 and depress the starting switches. The large hem fold, the small hem fold, the label insert and the seaming operations are all then completed in appropriate sequence in a few seconds, after which the pillowcases are automatically ejected from the machine. In practice, a single machine operator of minimum skills can easily attend to the operation of two machines, alternately feeding one while the other is completing a folding-sewing sequence.

Of significance to the invention is the unique arrangement, covered in our parent U.S. Pat. No. 3,865,058, for supporting the article and forming the so-called large hem. This arrangement includes cooperating inner and outer forms, on which the article is initially supported and placed under circumferential tension, and which cooperate with insertable hem folding shoes. The inner forms constitute rotatable article supporting drums such that, at the completion of the large hem folding operations, the article is supported on the drums in a condition to be manipulated for the necessary small hem folding and sewing operations.

For the production of a tubular article having both large and small hems, the invention contemplates the forming of the first or large hem in a single fold-over operation, by which the large hem is formed simultaneously about the entire circumference of the article. This initial hem folding operation is then followed by a progressive forming of the so-called small hem. In the system of the invention, commencement of the small hem folding operation is uniquely advantageous in providing for a three-stage starting sequence, followed by the circumferentially progressive continuation of the hem fold. In the three phase starting sequence, a first stage folder is advanced laterally toward and into contact with the raw edge of the fabric to bring about a 90° fold. This is followed immediately by moving a second stage folder laterally into contact with the fabric edge, immediately adjacent and downstream of the first stage folder, to complete a 180° underfold. A third phase of the start-up procedure involves a short reciprocation of the two folding stages, first in a downstream direction and then return, so that a prefolded section of the small hem extends downstream from the folder to and under the sewing foot, enabling the sewing operation to commence on a pre-formed section of the small hem fold.

The sewn seam detector incorporated in the apparatus of the present invention, while particularly useful in the association with the handling of tubular articles, would also be useful in conjunction with other articles held under tension in the direction of sewing. In this respect, the sewn seam detector relies upon the principle of deflecting the main body of fabric out of a plane in which it is held under tension. An immediately adjacent sensor rides along a layer of material intended to be sewed to the body portion. As long as the adjacent sections are properly sewed together, the deflection of the body portion will cause a similar deflection of the adjacent hem portion. If the seam is defective, however, the hem portion will be drawn by tension back toward the tension plane, allowing the sensor to detect a special difference between the adjacent fabric sections. The illustrated device has additional advantages in connection with the processing of tubular articles, in that it accommodates the start-up phase without creating a "false" no-sew signal, even though at the outset there is no seam underneath the sensor.

The sewn seam detector described herein also is particularly advantageous in conjunction with the sewing of tubular articles, providing a simple yet reliably effective means of timing the end of the sewing operation and the clearing away of the small hem folder, as the beginning of the sewn seam returns to the starting point.

In the apparatus of the invention, the sewing machine head, as well as the several hem tracking elements are provided with a common adjustable mount, enabling the apparatus to be quickly set up and readjusted for the processing of hems of various sizes.

It should be understood, of course, that the specific form of the invention herein illustrated and described is intended to be representative only, as many changes may be made therein without departing from the clear teachings of the disclosure. Accordingly, reference should be made to the following appended claims in determining the full scope of the invention.

I claim:

1. The method of detecting a no-sew condition in a hemmed article during a sewing operation, which comprises a. placing an unsupported region of the hemmed margin of the article under tension in the direction of the sewing, whereby a tension plane of the article is formed, b. deflecting the article in the area of said unsupported region immediately adjacent but beyond the free edge of the hem in a direction away from said free edge and out of said tension plane thereby tending to effect a separation of the deflected portion of the article from said free edge, and c. sensing the position of said free edge relative to said deflected portion, whereby a separation of said edge from said deflected portion in a direction toward said tension plane reflects a non-sewn condition of the hem.

2. Means for detecting a sewn or unsewn condition between two layers of material, which comprises a. means for supporting said layers of material under tension in the sewing direction, whereby a tension plane of said layers is formed, and with one layer projecting out from under the other in a direction at right angles to the sewing direction, b. a deflector member positioned to contact the projecting portion of said one layer and being adjacent to but out of contact with said other layer, c. said deflector member being operative to divert said projecting layer out of said tension plane, thereby effecting a separation of said projecting layer from said other layer when a non-sewn condition exists and deflecting said other layer out of said tension plane along with said projecting layer when a sewn condition exists, and d. means to sense the path of the other layer of material in the region of said deflector member.

3. The detecting means of claim 2, further characterized by a. said means to sense comprising a movable sensing element carried by said deflector member.

4. The method of detecting a no-sew condition in a hemmed article during a sewing operation, which comprises a. providing an unsupported region of the hemmed margin of the article in an area downstream of the sewing operation, b. applying a separating force into said unsupported region tending to relatively separate the free edge of said hem from the underlying portion of the article in a direction at right angles to the plane of the underlying portion, and c. sensing the separation of said free edge relative to said underlying portion, whereby a separation of said edge from said portion reflects a non-sewn condition of the hem.

* * * * *